United States Patent [19]

Rodgers

[11] 4,437,505

[45] Mar. 20, 1984

[54] DRAPERY CLOSURE

[76] Inventor: Patricia Rodgers, 17291 Buttonwood, Fountain Valley, Calif. 92708

[21] Appl. No.: 410,380

[22] Filed: Aug. 23, 1982

[51] Int. Cl.[3] ..... A47H 23/01

[52] U.S. Cl. ..... 160/126

[58] Field of Search ..... 160/126, 124, 340, 341, 160/DIG. 12; 2/265, 218, 234, 96

[56] References Cited

U.S. PATENT DOCUMENTS

| | | | |
|---|---|---|---|
| 2,176,229 | 10/1939 | Siegel | 2/234 |
| 2,434,233 | 1/1948 | Spearrin | 2/234 |
| 3,001,578 | 9/1961 | Ratliff | 160/126 |
| 3,046,564 | 7/1962 | Roseman et al. | 2/234 X |
| 3,230,545 | 1/1966 | Galley | 2/96 X |
| 3,261,024 | 7/1966 | Delaney | 2/DIG. 2 |
| 3,962,729 | 6/1976 | Cook | 2/265 |

FOREIGN PATENT DOCUMENTS

| | | | |
|---|---|---|---|
| 1427224 | 12/1965 | France | 2/96 |

*Primary Examiner*—Peter M. Caun
*Assistant Examiner*—Cherney S. Lieberman
*Attorney, Agent, or Firm*—Francis X. LoJacono

[57] ABSTRACT

A drapery or curtain structure having two or more panels adapted to be hung in a suitable known manner, wherein the juxtaposed vertical edges of the adjoining panels are formed having elongated pleats defined by a pair of sections, whereby the pleat sections of each panel are arranged to overlap each other in a locking manner by means of a securing device that is located within each pleat.

4 Claims, 5 Drawing Figures

DRAPERY CLOSURE

BACKGROUND OF THE INVENTION

1. Field of the Invention

This invention relates generally to draperies and the like of the type used to cover windows and create areas of privacy, and more particularly to a drapery or curtain structure wherein two or more panels thereof include a unique arrangement for securing the panels in a closed mode.

2. Description of the Prior Art

It is well known in the art that various problems and difficulties are encountered in providing suitable means for securing in a closed manner the overlapping edges of adjoining sections of curtains or draperies.

Various types of hanging draperies or curtains are employed to maintain privacy, as well as to screen sunlight. However, this overlapping of the edges does not always provide a positive screening for privacy, since the edges can be readily parted if they are located over a window or sliding door that has been opened to allow a breeze to pass through.

The overlapping edges can be held together by fastening means such as pins, but such pins are unsightly when left exposed. Still other known fasteners have features that restrict their use and application to particular situations or areas. To the applicant's knowledge, none of the known devices solves the existing problems which the present invention overcomes.

SUMMARY OF THE INVENTION

The present invention has for an important object a provision wherein suitable fastening devices are secured along the adjoining connecting edges of each drapery or curtain panel in such a manner that the devices are not visible when either in a secured or unsecured mode.

Another object of the invention is to provide means for securing the edges of adjoining curtain or drapery panels in an overlapping fashion, wherein one member of the fastening device is attached along one inner surface of an elongated pleat formed along the connecting edge of the curtain or drapery fabric, and a second member of the fastening device is attached to the inner surface of an elongated pleat formed in the second adjoining curtain or drapery fabric. Accordingly, the two juxtaposed elongated pleats are interconnected by a double overlapping arrangement, whereby the fastening members can be connected yet hidden from view. Or, the fastening devices can be disconnected, thus allowing the adjoining pleats to separate with the fastening member hidden within the pleated structure of each curtain or drapery panel.

It is another object of the invention to provide a devcie of this character that is compatible with curtains and/or draperies employed in all types of living quarters—including recreational vehicles and boats—to establish closed private areas therein.

Still another object of the invention is to provide a device of this character that can be used to create privacy areas in bedrooms, dressing rooms and bathrooms, for example.

A further object of the present invention is to provide a device of this character that is easy to install, service and maintain.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only.

DESCRIPTION OF THE PREFERRED EMBODIMENT

Figure 1:
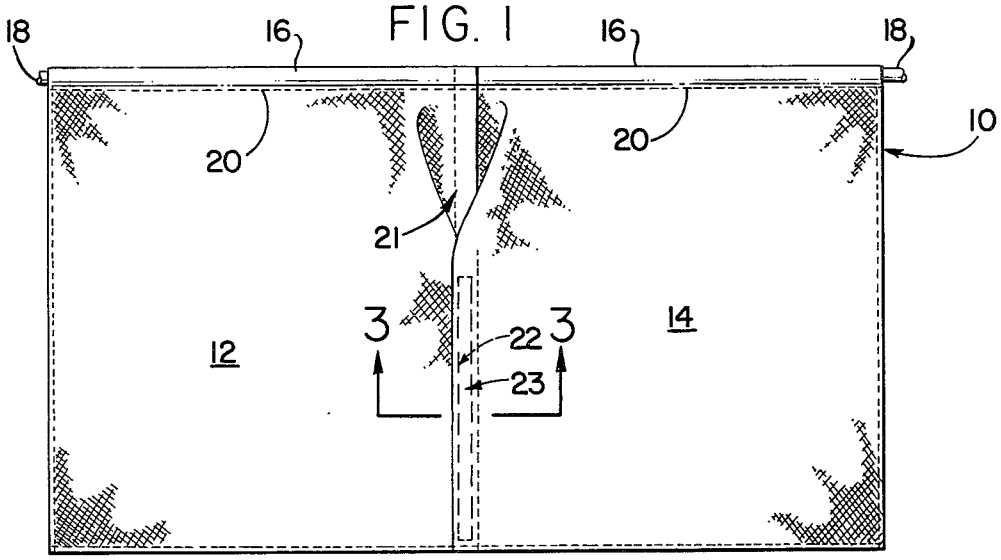
FIG. 1 is a front-elevational view of a pair of adjoining drapery or curtain panels showing the overlapping connected edges thereof.
Figure 2:
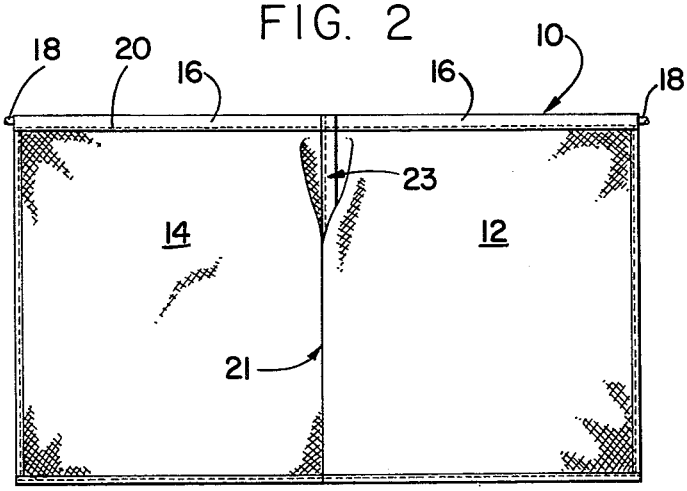
FIG. 2 is a rear-elevational view similar to that illustrated in FIG. 1.

Referring more particularly to FIGS. 1 and 2, there is shown therein a drapery or curtain assembly, generally indicated at 10, which is shown having a first and a second drapery or curtain panel, indicated respectively at 12 and 14. For simplicity of description, the drapery or curtain panel will herein be referred to as "panel" which will be understood to relate to draperies, curtains and the like.

Typically, each panel is formed from a suitable fabric having a means provided along its upper edge 16 for hanging the panel in a normal juxtaposed manner. As a typical example, upper edge 16 is constructed as a continuous tubular member adapted to receive a support rod 18 therethrough, the tubular member being formed by lapping edge 16 and sewing it, as indicated at 20.

Accordingly, the present invention is provided to establish a positive releasable securing means between the adjacent vertical edges 21 and 23 of the panels 12 and 14, the securing means (indicated generally at 22) being completely hidden from view by means of an elongated pleat formed along the adjacent edges 21 and 23.

Figure 4:
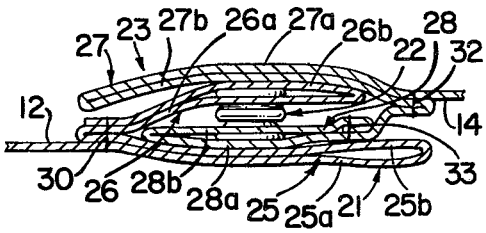
FIG. 4 and FIG. 5 are cross-sectional views similar to that shown in FIG. 3, with each respective view illustrating a different type of fastening device that is compatible in combination with the present invention.
Figure 5:
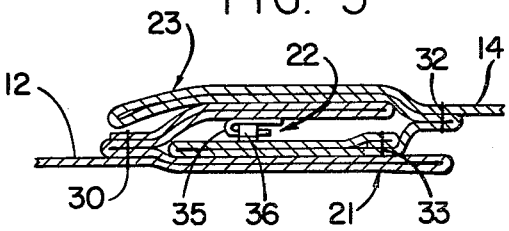

The pleated edge 21 of panel 12 is identical in structure to the pleated edge of panel 14. That is, edge 21 is formed having a pair of pleat sections 25 and 26, and edge 23 is formed having a pair of pleat sections 27 and 28, each of the pleat sections being double folded. Pleat section 25 has folded members **25*a* and 25*b*, and pleat section 26 has folded members 26*a* and 26*b*. All folded members are secured into proper pleated relationship by thread 30. Likewise, pleat sections 27 and 28 are formed and folded in a similar manner, thereby providing folded members 27*a* and 27*b*, and 28*a* and 28*b*, which are secured by threads 32 and 33 as illustrated in FIGS. 3, 4 and 5**.

Figure 3:
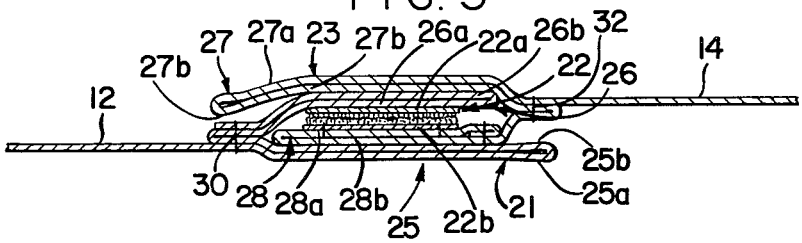
FIG. 3 is an enlarged, horizontal, cross-sectional view taken along line 3—3 of FIG. 1, showing one embodiment of a fastening means included therein.

Referring more particularly to FIG. 3, the securing means 22 is herein shown as having a "velcro" (trademark) fastener which comprises a cloth-like fabric having a male member and an oppositely positioned female member. One of the connecting members is attached to inner member **26*a* of pleat section 26, and the opposite connecting member is attached to the inner member 28***b* of pleat section 28.

When the two panels are to be secured together, pleat section 26 is positioned so as to be interposed between pleat sections 27 and 28, and pleat section 28 is interposed between pleat sections 25 and 26, respectively, whereby the two opposing fastener members *22a* and *22b* are coupled together, as is well known in the art. This allows for a positive closure between the two adjacent curtain or drapery panels.

However, it is contemplated that more than two panels could be interconnected by providing additional panels having pleats along both vertical edges with fastening means positioned therein.

FIG. 4 illustrates the pleats 25, 26, 27 and 28 in their respective fastened positions, but provided with an alternative securing means 22 which comprises a suitable snap-button fastener positioned so as to be readily secured when the adjacent edges of the panels are overlapped as shown.

Still another securing means 22 is illustrated in FIG. 5. This securing means is defined by a hook 35 and an eye 36.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A drapery or curtain structure in combination with a securing means, comprising:

a drapery or curtain structure having at least two panels, thus defining a first and second panel positioned adjacent each other to provide adjoining vertical edges;

a first pleat formed along the adjoining edge of said first panel, said first pleat being defined by first and second parallel pleat sections integrally formed as part of said first panel, said first pleat section being formed by a first pair of folded members, and said second pleat section being formed by a second pair of folded members;

a second pleat formed along the adjoining edge of said second panel, said second pleat being defined by first and second parallel pleat sections integrally formed as part of said second panel, said first pleat section being formed by a first pair of folded members, and said second pleat section being formed by a second pair of folded members;

securing means comprising at least one male fastening member and at least one corresponding female fastening member, wherein one fastening member is mounted to said second pleat section of said first pleat and the other fastening member is mounted to said second pleat section of said second pleat, whereby said securing means is interposed within said pleats, wherein said second pleat section of said first pleat is interposed between said first and second pleat sections of said second pleat, and said second pleat section of said second pleat is interposed between said first and second pleat sections of said first pleat, whereby said adjacent vertical edges of said panels are joined substantially throughout their length.

2. The combination as recited in claim 1, wherein said male and female fastening members comprise a fabric-like material.

3. The combination as recited in claim 1, wherein said male and female fastening members comprise a pair of interconnecting button members.

4. The combination as recited in claim 1, wherein said male and female fastening members comprise a hook member and an eye member respectively.

* * * * *